United States Patent [19]

Aebli et al.

[11] Patent Number: 4,980,950

[45] Date of Patent: Jan. 1, 1991

[54] APPARATUS FOR OPENING BALES OF TEXTILE FIBERS

[75] Inventors: Jost Aebli; Daniel Hanselmann; Walter Schlepfer, all of Winterthur, Switzerland

[73] Assignee: Maschinenfabrik Rieter AG, Winterthur, Switzerland

[21] Appl. No.: 455,184

[22] Filed: Dec. 22, 1989

[30] Foreign Application Priority Data

Dec. 23, 1988 [DE] Fed. Rep. of Germany ..... 3843656

[51] Int. Cl.[5] ..... D01G 7/06

[52] U.S. Cl. ..... 19/80 R

[58] Field of Search ..... 19/80 R, 80 A, 81

[56] References Cited

U.S. PATENT DOCUMENTS

| | | | |
|---|---|---|---|
| 4,507,826 | 4/1985 | Keller et al. | 19/80 R |
| 4,513,479 | 4/1985 | Binder et al. | 19/81 |

FOREIGN PATENT DOCUMENTS

| | | | |
|---|---|---|---|
| 0265756 | 5/1988 | European Pat. Off. | 19/80 R |
| 3631466 | 3/1988 | Fed. Rep. of Germany | 19/80 R |
| 0608856 | 5/1978 | U.S.S.R. | 19/80 R |

*Primary Examiner*—Werner H. Schroeder
*Assistant Examiner*—John J. Calvert
*Attorney, Agent, or Firm*—Burns, Doane, Swecker & Mathis

[57] ABSTRACT

In an apparatus for opening bales of textile fibers, a deflecting member for the fiber flocks is arranged within the housing and extends in the longitudinal direction of the opening roll. This deflecting member deflects fiber flocks supplied on the one side of the roll into the conveying shaft, at least largely prevents leakage air coming from the other side of the roll, and is able to shift in position under the action of blows which act on it during bale opening, for example blows caused by foreign articles. The deflecting member is pivotally secured in the region of its longitudinal edge adjacent the roll, to respective links for executing pivotal movements about an axis which extends parallel to such longitudinal edge. The opposite ends of the links are in turn pivotally journalled on the housing. Moreover, an extendible and retractable unit is provided for changing over the direction of the deflecting member in accordance with the direction of rotation of the opening roll.

20 Claims, 7 Drawing Sheets

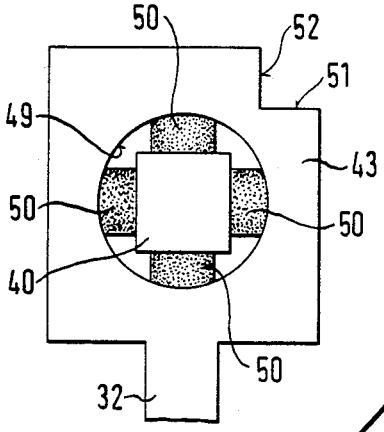
Fig. 2A
Fig. 1
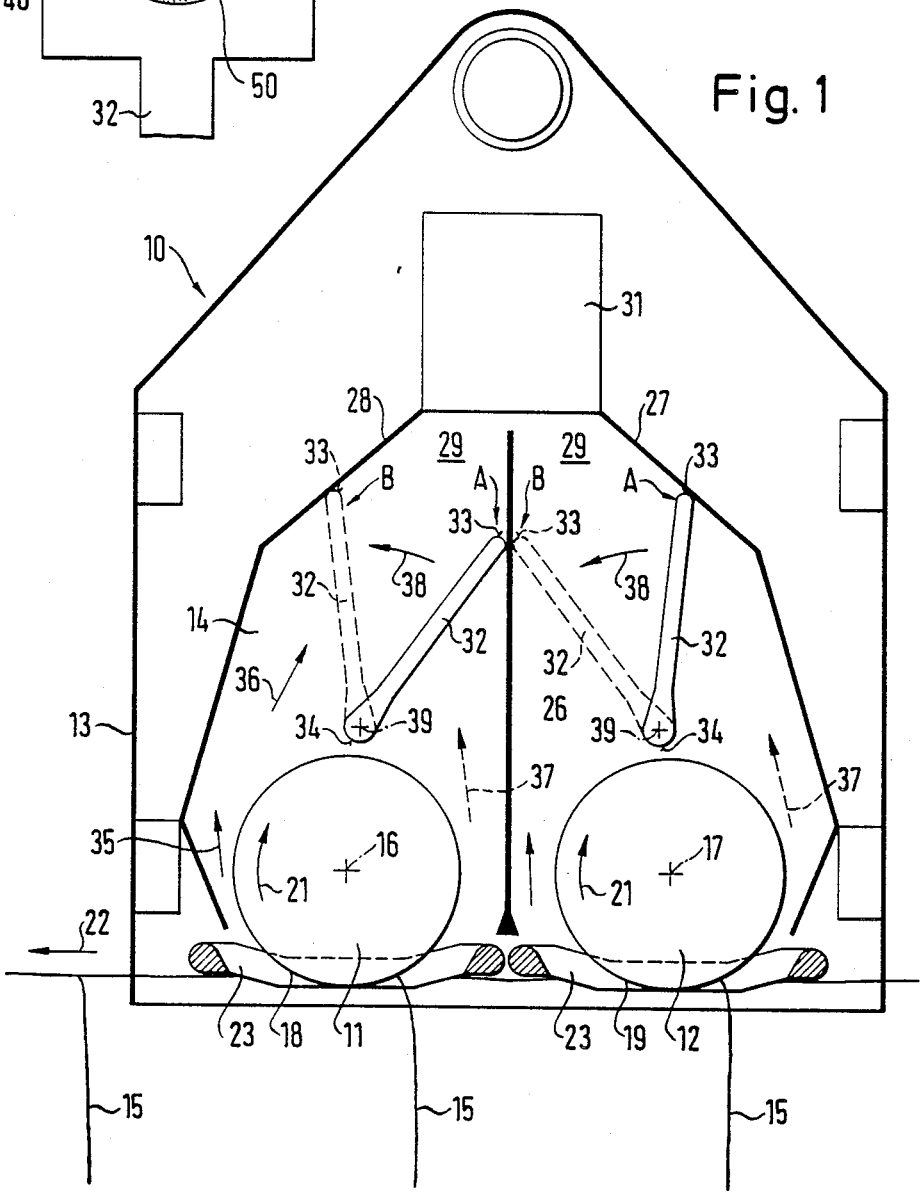

APPARATUS FOR OPENING BALES OF TEXTILE FIBERS

FIELD AND BACKGROUND OF THE INVENTION

The present invention relates to apparatus for opening bales of textile fibers. It is concerned particularly with bale openers adapted to accommodate the blows which are inflicted by ropes and other foreign objects thrown from the bales during operation of the apparatus.

The type of bale opener with which the present invention is concerned includes at least one opening roll which is rotatably journalled within a housing. The housing is open at its side facing the fiber bales and the direction of rotation of the roll is reversible depending on the prevailing direction of travelling movement of the housing relative to the fiber bales. The roll and the housing walls are spaced apart to provide flow channels and suction is applied to draw air and fiber through the channels and to an outlet conveyor duct. There is a deflection member for the fiber flocks which extends longitudinally over the top of the roll. It deflects fiber flocks supplied on one side of the roll into the fiber flow passage and at least largely prevents leakage of air coming from the other side of the roll. It is desirable that this deflection element be able to deviate or shift under the action of blows (such as those caused by foreign particles) which act on it during bale opening.

An apparatus of this general kind is for example disclosed in European Patent Application Publication No. 130 369.

The articles which cause such blows are frequently ropes or other foreign articles which are present in the bales. Such blows can also arise through large quantities of torn out fiber flocks. The sensitivity of the apparatus against such blows, and above all the ability of the deflecting member to deflect rapidly in order to avoid damage to this member is restricted by the inertia of the deflecting member and the parts which move with the latter. In order to ensure a light manner of construction of the deflecting member, the pivot axis of the deflecting member must be so arranged in the known arrangement that the pressure difference acting on the pivot member does not lead to any deformation or excess loading of the deflecting member or of the positioning means therefor.

There are however certain restrictions with respect to the position of the axis of rotation of the deflecting member and also its construction. In further embodiments of the known apparatus the deflecting member is only used to deflect the fibers and a separate pivotally mounted flap bounds the conveyor path and bears eventual blows from foreign articles. This additional separate flap however represents a complication of the apparatus. While this complication may be acceptable in an arrangement with only one roll, one would prefer not to have these separate flaps, particularly in apparatus having two rolls disposed alongside one another.

SUMMARY OF THE INVENTION

Objects of the present invention are to provide apparatus of the initially named kind that permits the inertia of the deflecting member and of the parts movable therewith to be reduced without the penalty of a complicated arrangement, and to provide an apparatus of this kind which is well suited for installation in bale opening machines with two opening rolls arranged alongside one another.

In accordance with the invention, the deflecting member is formed as a pivotable flap which is pivotally secured at its side ends, via respective pivot axes, in the region of its longitudinal edge adjacent the roll to respective links for executing pivotal movements about an axis of rotation which extends parallel to the longitudinal edge. The two links ar pivotally journalled on the housing at their ends remote from the pivot axes; and at least one means acts on at least one of the pivot axes to change over the direction of the pivotal flap in accordance with the direction of rotation of the opening roll.

In this way a very compact deflection device is provided, and the different positions of the pivot axis of the pivotal flap for the deflection movement and the pivot axis of the link for the deviation movement make it possible to attain an excellent adaptation to the technical circumstances. Since the deviation movement of the pivotal flap and of the link arrangement takes place on the occurrence of blows about a pivot axis which is located in the region of one longitudinal edge of the pivot flap, the inertia of this arrangement is substantially reduced relative to the known arrangement in which a partly cylindrical deflecting member is pivotable about the cylinder axis.

In an apparatus for opening bales of textile fibers in which the roll is pivotally journalled on plates at the end faces of the housing, the apparatus of the invention is preferably characterized in that the pivot flap is located between the plates whereas the links are arranged outside of the plates.

In this arrangement, provision is made that the pivot axes extend through the respective plates and that the plates have arc-like slots for the pivot axes with the arc-like slots being of circular curvature and having a center of curvature which coincides with the pivot axis of the links.

In this way the links and also the means for deflecting the pivot flap can be arranged at the outersides of the plates so that they are readily accessible and are not subjected to any particular danger of contamination, since they lie outside of the fiber conveying region. It is only the pivot flap itself which is located between the plates.

In a particularly preferred embodiment, the means for changing over the pivot flap comprises an extendible and retractable unit which is pivotally connected at its one end on a lever which is pivotally fixedly mounted on the associated pivot axle and is likewise pivotally mounted to a link at a distance therefrom.

In this arrangement, provision is preferably made that the extendible and retractable unit is pivotally connected at its end remote from the lever to a further lever which is mounted on the associated link in the region of its pivot axle at the housing.

In this way the drive means for the deflection of the pivot flap, which is preferably constructed as an extensible and retractable piston and cylinder drive, or as an extensible and retractable spindle drive, can be so mounted that it participates in deviation movements of the link and of the pivot flap without a separate resilient mounting for the motor being necessary.

This however also has the advantage that the angular position selected during the change-over between the pivot flap and the link is also retained during the deviation movements. Thus the deviation movements executed by the pivot flap and by the links can be predetermined within close limits, which substantially simplifies the design and the computation of the inertia. Furthermore, the stresses which occur in the case of blows in the extendible and retractable unit provided for deflection of the flap are restricted, so that this unit does not need to be made excessively large in order to bear these stresses, and the inertia of the arrangement is not unnecessarily increased by an over-dimensioned drive unit.

The position of the links is, in accordance with the invention constant during the entire normal operation of the apparatus. It only changes during deviation movements as a consequence of blows. This constant position of the links can be realized in accordance with the invention in a particularly simple manner if one provides a spring system which acts on one or both links and biases these into the predetermined position. The spring system also serves to resiliently accommodate the forces which arise through blows. For small blows, which need not lead to interruption of operation, the spring system moves the links and the pivot flaps back into the desired initial positions after the foreign matter has passed.

In accordance with a particularly preferred embodiment, the spring system is so constructed that the pivotally journalled end of the biased link has an opening through which a boss passes. The boss determines the pivot axis for the link and elastomeric spring elements are arranged in this opening between the link and the boss.

By building the spring system into the region of the pivot axis of the link, the inertia of the entire arrangement is also kept small. Although the above mentioned spring system using elastomeric springs is preferred, a spring system could also be realized in another manner. For example, the boss which determines the pivot axis of the link could be formed as a torsion spring or torsion bars.

Since the foreign articles which cause heavier blows must be removed from the machine, it is desirable to interrupt the operation of the machine, or at least to generate a warning signal, when such blows occur. This can take place in accordance with the invention through the provision of switching cams at the head of the link which swings in response to the blows. The switching cams activate appropriate electric switches to bring about the desired effects. One can construct the arrangement such that the switching cams are mounted on the link (or on parts movable with the latter) and cooperate with a counter element during a deflection of the link in response to a blow to initiate a switching process for generating a warning signal and/or for stopping the operation of the machine.

As initially mentioned, the apparatus of the invention is particularly well suited for bale opening machines with two opening rolls arranged alongside one another. A machine of this kind is preferably constructed such that it has two opening rolls arranged alongside one another in a common housing; that a partition wall is arranged between the two rolls with the partition wall extending upwardly and bounding, together with the housing, at least a part of the fiber passage; that one pivot flap is provided for each roll and that the two pivot flaps are deflectable in the same rotational sense corresponding to the prevailing direction of rotation of the rolls.

In a bale opening machine of this kind, the arrangement of the invention is such that, in one deflection position of the pivot flaps, the longitudinal edge of one of the flaps remote from its associated roll contacts the partition wall, while the corresponding edge of the other pivot flap contacts the wall of the fiber passage formed by the housing. In the other deflection position, the longitudinal edge of the first pivot flap remote from its associated roll contacts the wall of the fiber passage formed by the housing, while the corresponding edge of the other pivot flap contacts the partition wall.

BRIEF DESCRIPTION OF THE DRAWINGS

The invention will now be explained in further detail in connection with embodiments illustrated in the drawings, in which:

FIG. 1 is a schematic cross-section through an opening arm of a bale opening machine with two opening rolls;

FIG. 2A is a detail from FIG. 2;

DETAILED DESCRIPTION OF PREFERRED EMBODIMENTS

Figure 2:
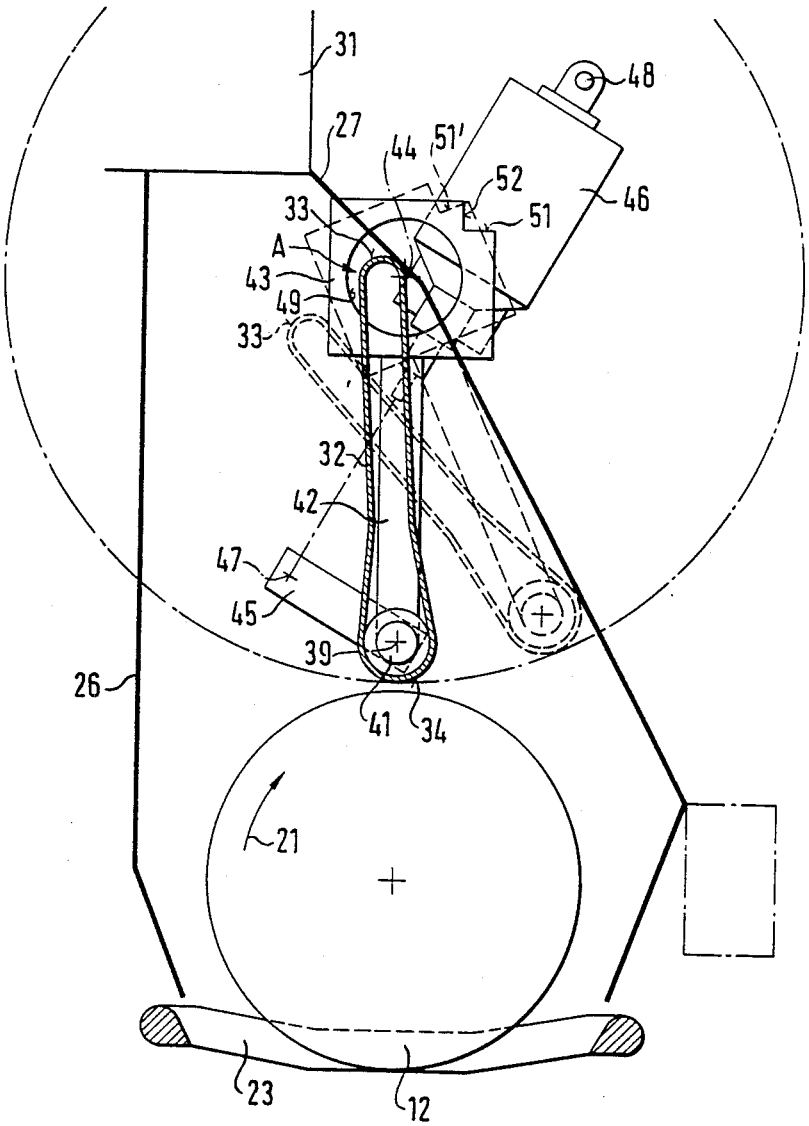
FIG. 2 is a schematic illustration of the right-hand opening roll of FIG. 1 with the pivot flap in the position A and with additional particulars of the arrangement being shown.

FIG. 1 shows first of all a cross-section through the opening arm 10 of a bale opening machine having two opening rolls 11 and 12 which are arranged parallel to one another in a housing 13 formed by the arm 10. At its two side ends the housing has so called shields (plates) of which only the rear plate 14 can be seen in FIG. 1.

The opening rolls 11 and 12 which carry toothlike members (not shown) in order to free the fiber flocks from the bales 15 lying beneath them are rotationally journalled in the shields 14. The rotational axes of the rolls 11 and 12 are designated by 16 and 17, respectively. The circles 18 and 19 show the circular paths of movement of the tips of the teeth when the opening rolls 11 and 12 move in the direction of rotation 21 which corresponds to an opening movement of the arm along a row of bales in the direction of the arrow 22.

The housing 13 is open at its lower side facing the row of bales 15 so that the teeth of the opening rolls 11 and 12 can extend through gaps between the customary grid bars 23 in the lower part of this circular movement in the direction of the arrow 21. The grid bars 23 or the grids formed hereby can be constructed in accordance with German patent application P 38 20 427.4 or in accordance with the German patent application P 38 27 517.1 or otherwise. As usual the teeth of the opening rolls execute a swash plate movement during their rotary movement about the respective axes of rotation 16 and 17.

A vertical partition wall 26 is located between the two opening rolls 11 and 12 and, in its upper region, forms two flock passages or conveyor shafts 29 with two wall parts 27, and 28 of the housing 13. These two conveyor shafts open into a flock conveying duct 31 which extends along the opening arm 10 and which is connected to a source of suction.

Above the opening roll 11 there is located a pivot flap 32 and a corresponding pivot flap 32 is also to be found above the opening roll 12.

In the position A shown with continuous lines, the upper longitudinal edge 33 of the left-hand pivot flap 32 is in contact with the partition wall 26. The lower longitudinal edge 34 of the left-hand pivot flap is located above the opening roll 11. In this manner the pivot flap 32 forms, together with the opposite wall part 28 of the housing, a conveying passage for the flocks which are removed from the bales 15 and separated out by the opening roll 11. These flocks first move in the direction of the arrow 35 and are then deflected into the direction of the arrow 36 and fed into the conveyor shaft 31. At the same time the pivot flap 32 blocks the flow of leakage air in the direction of the arrow 37 through the gap between the right-hand side of the opening roll 11 and the partition wall 26. This leakage air flow would otherwise arise because of the vacuum in the conveyor shaft 29 resulting from the connection of the conveyor duct 31 to a suction source. By blocking this leakage air flow, the illustrated arrangement causes the suction to act on the flocks to move them in the direction of the arrow 35 and to transport them through the shaft 29 and into the conveyor duct 31.

The upper longitudinal edge 33 of the right-hand pivot flap 32 in FIG. 1 contacts the wall 27 of the housing 13 and likewise blocks a leakage air flow in the direction of the arrow 37 between the right-hand side of the opening roll and the wall 27. The flocks removed by the roll 12 move between this right-hand pivot flap 32 and the partition wall 26 into the right-hand conveyor shaft 29.

It is shown in broken lines that both the left-hand pivot flap 32 and also the right-hand pivot flap 32 can be swung over in the direction of the arrows 38. They swing about respective pivot axes 39 which are located in the region of the lower longitudinal edges 34 of the respective pivot flaps. This pivotal movement is carried out until the upper longitudinal edge 33 of the pivot flap on the left-hand side of the partition wall 26 contacts the wall 28 of the housing and until the corresponding upper longitudinal edge 33 of the right-hand pivot flap contacts the partition wall 26. Such positions are indicated in both cases by the letter B.

FIG. 2 shows further particulars of the suspension of the right-hand pivot flap 32 of FIG. 1 at the time when this pivot flap is located in the position A. It will be understood that the drawing of FIG. 2 could also represent a drawing of a pivot flap in the position A in a bale opening machine which has only one opening roll 12.

From FIG. 2 one can see that a pivot axle in the form of the stub axle 41 is mounted on the pivot flap 32 in such a way that it is coaxial to the pivot axis 39, i.e., it extends in the lower region of the pivot flap parallel to its longitudinal edge 34. This stub axle 41 is pivotally mounted in one end of a vertically upright link 42, the other end of which terminates in an enlarged approximately square head 43 which is pivotally arranged about a pivot axis 44. A one-armed lever 45 is rotationally fixedly secured to the pivot axle 41 and an extendible and retractable device 46, such as a cylinder and piston unit, is pivotally connected to the free end of the one-armed lever 45 at 47. The end of the unit 46 remote from the lever 45 is pivotally connected at 48 to one plate of the arm 10 of the bale opening machine.

The link 42 can be pivotally connected to the plate of the arm 10 by spring means. As can be seen from FIG. 2 the enlarged end 43 of the link 42 has a circular opening 49 through which, as shown in FIG. 2A, a boss secured to the shield of the opening arm passes. As is evident from FIG. 2A four rubber blocks 50 are inserted between the square shaped boss 40 and the wall of the opening 49 and ensure that the link 42 is biased into the position illustrated in FIG. 2.

If now a foreign article, such as for example a length of rope, is released from the fiber bale and thrown by the movement of the opening roll against the lower edge 34 of the pivot flap 32 and the pivot flap can deflect through compression of the rubber blocks into the position illustrated in broken lines in FIG. 2.

As likewise evident from FIG. 2*a* two switching cams 51 and 52 are provided at the upper edge of the square head 43 of the link 42. During the deflection movement of the pivot flap 32 into the broken line position of FIG. 2 the switching cam 51 moves into the position 51' and there actuates a corresponding switch (not shown) which serves to generate a warning signal and/or to stop the operation.

The switching cams 51 and 52 do not need to be provide at the head of the link 42. Instead an initiator or an infrared light barrier can also be provided which is directed towards the lever 45. This initiator can serve two functions: first of all, a switching-off function in the end position on extension or retraction of the unit 46, and secondly, a monitoring function when a blow at the edge 34 causes the pivot flap 32 to deflect. In the latter case the operation can be interrupted and/or a warning signal can be triggered.

Figure 3:
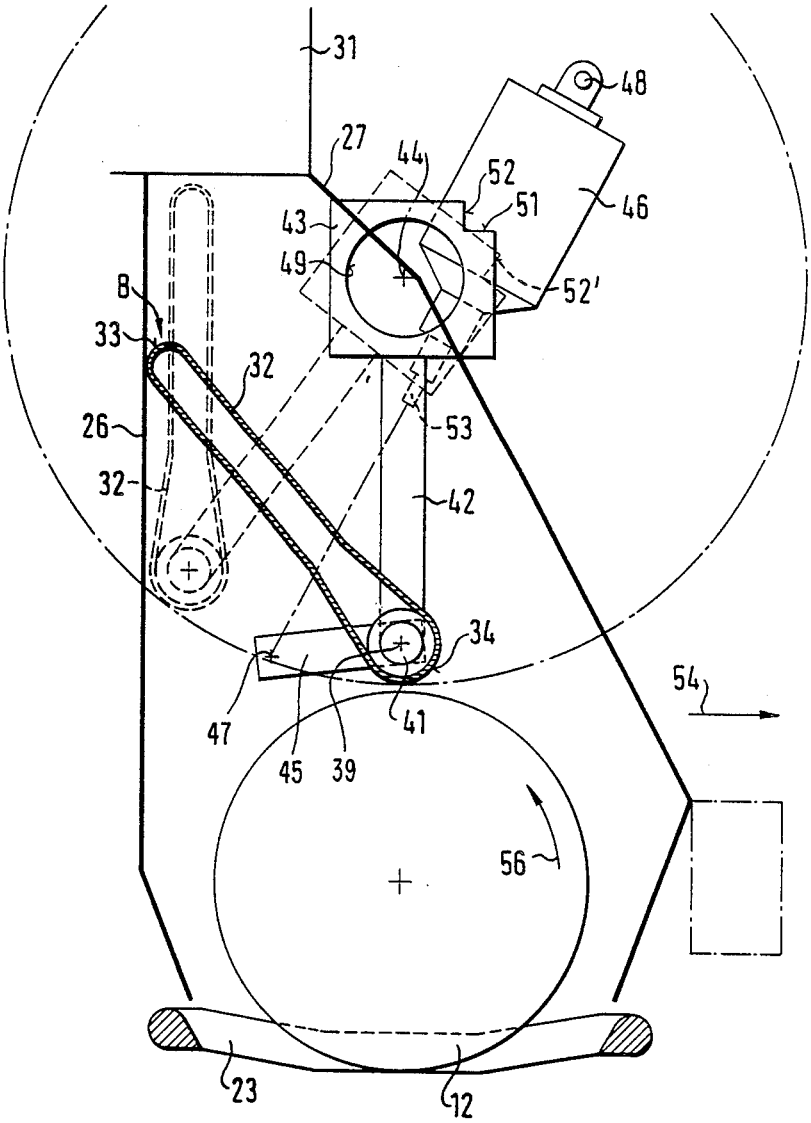
FIG. 3 is the same arrangement as FIG. 2 but with the pivot flap in the position designated B in FIG. 1.

FIG. 3 shows the same arrangement as FIG. 2 with the exception that the spindle 53 of the spindle drive 46 is extended in order to bring the pivot flap 32 into the inclined position shown with continuous lines in which its upper longitudinal edge 33 contacts the partition wall 26, i.e., the pivot flap 32 is located in the position B. One sees that the link 42 retains its vertical position during this movement. In this position the opening arm moves in the arrow direction 54 while the opening roll 12 now operates in the counter clock-wise direction of arrow 56. If now a foreign article executes a blow on the lower edge 34 of the pivot flap 32, the latter deviates into the angular position shown in broken lines against the bias of the spring means of FIG. 2*a*. During this movement the switching cam 52 moves into the position shown at 52' and actuates a switch which in turn serves to stop the machine and/or to generate a warning signal.

Figure 4:
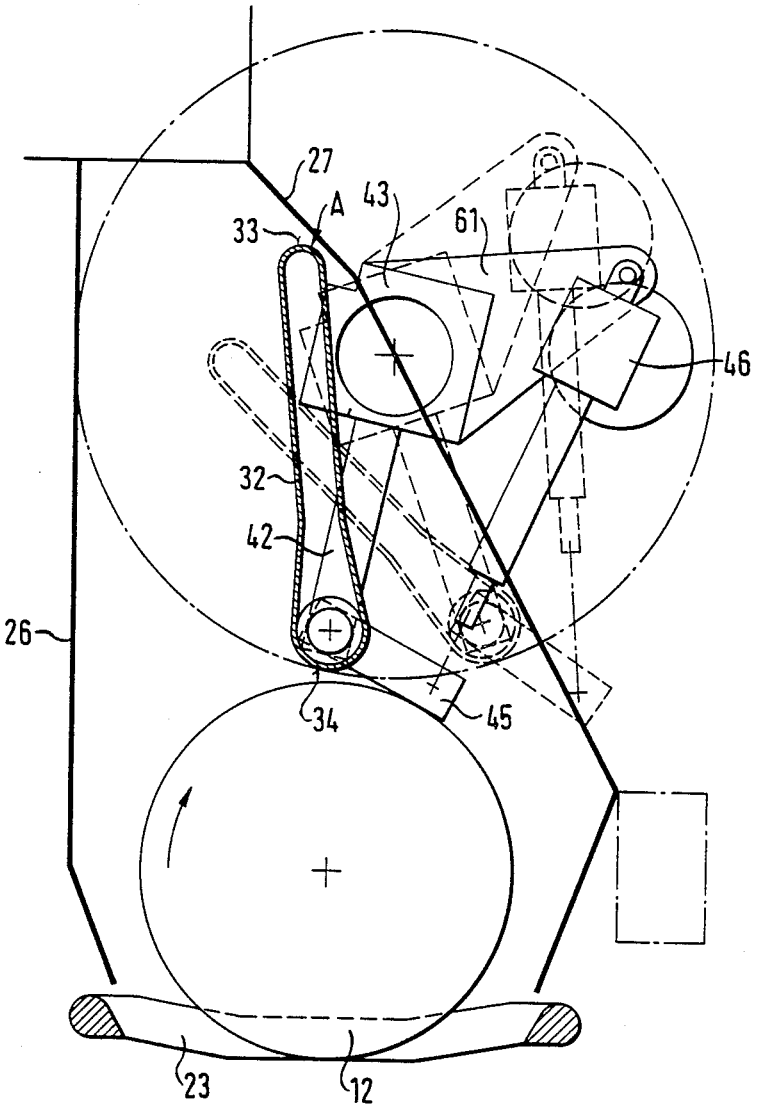
FIG. 4 is a representation which largely corresponds to FIG. 2, but which shows a somewhat modified embodiment.

FIG. 4 shows a representation of an embodiment which is similar to the embodiment of FIG. 2, but in which the lever 45 has a different angular position in comparison to the corresponding lever 45 of FIG. 2. The switching drive unit 46 of this embodiment is also not pivotally connected to the shield or housing of the opening arm but rather to the end of a further one-arm lever 61, the other end of which is secured to the enlarged head 43 of the link 42. In this way the retractable and extendible unit 46 fully participates in the deviation movement as is shown by the broken line illustration of the unit 46.

Figure 5:
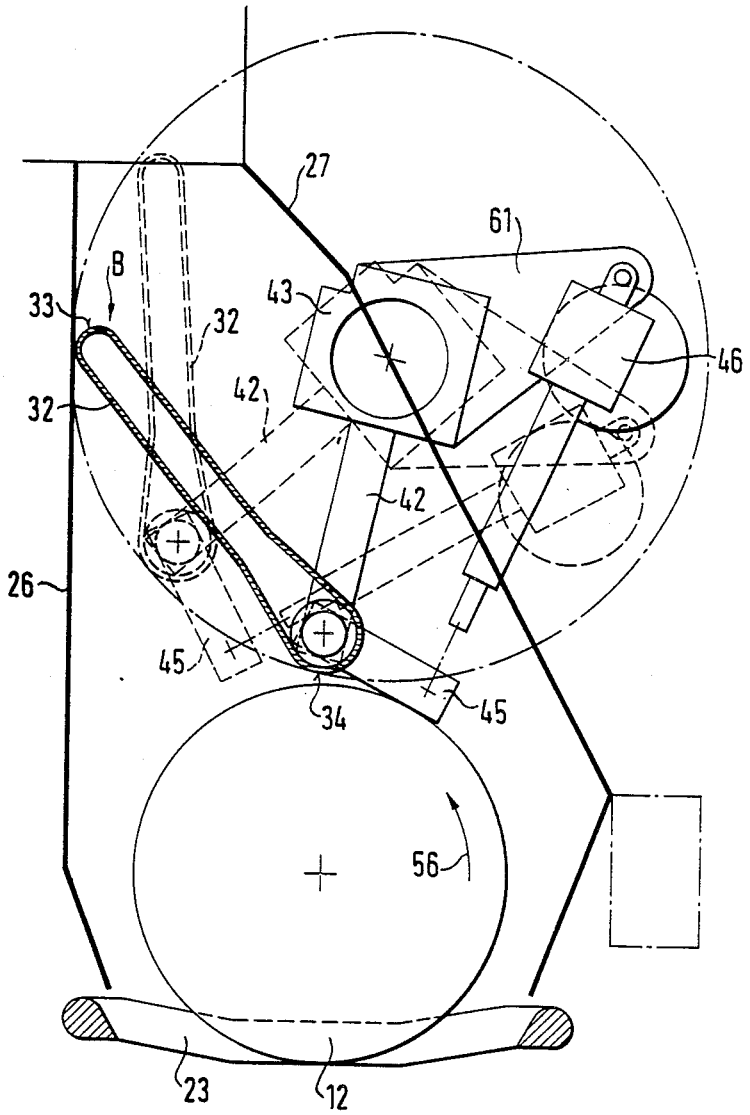
FIG. 5 is the same arrangement as FIG. 4, but with the pivot flap in the position B of FIG. 1.

FIG. 5 then shows the arrangement of FIG. 4 after the pivot flap has been swung over into the inclined position B, in this case by retraction of the unit 46 in comparison to the extended position shown in FIG. 4.

It will be understood that a unit 46 of this kind can be provided at only one end of the pivot flap or at both ends of the pivot flap. This also applies for all other embodiments. It is also to be understood that the pivot flap on the left-hand side of the double arrangement of FIG. 1, together with the associated drive and link, may be constructed as in the arrangement at the right-hand side of FIG. 1.

Figure 6:
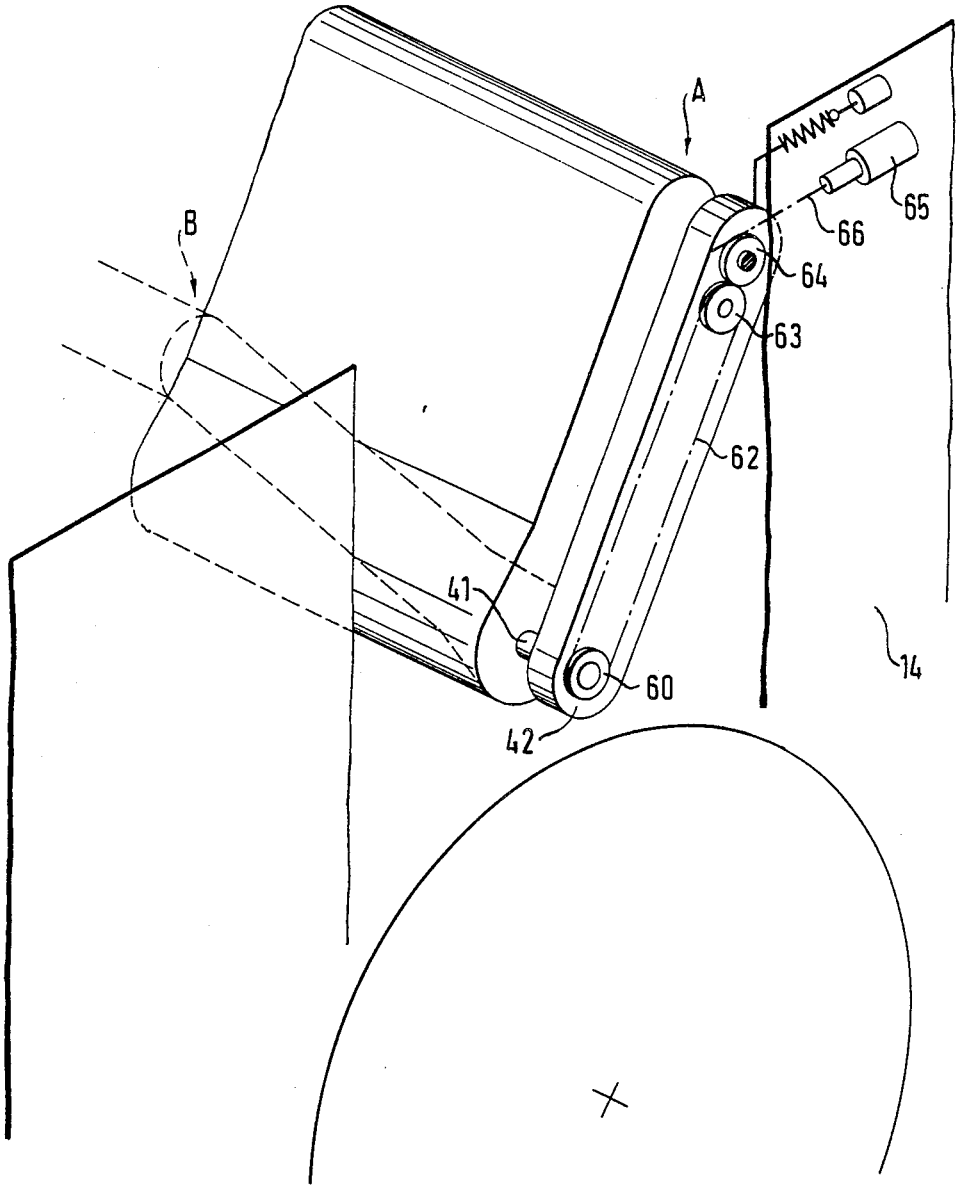
FIG. 6 is a perspective illustration of a further embodiment.

FIG. 6 shows a perspective illustration of a modified embodiment in which the same parts have the same reference numerals as in the previous Figures and in which the plate 14 of the housing 13 of the opening arm 10 is also visible.

For the sake of illustration only the one end of the pivot flap is shown. One can see that the pivot axle 41 of the pivot flap is also pivotally arranged in one end of the link 42. In this embodiment, however, the end of the pivot axle 41 which projects through the link 42 carries a belt pulley 60 which is pivotally connected via a belt 62 with a deflection pulley 63. The deflection pulley 63 is pivotally journalled on a stub axle on the link 42. Above the pulley 63 there is located a further pulley 64 which engages with the outerside of the belt 62 or, as an alternative, is rotatably coupled with the pulley 63 via gear wheels (not shown). The further pulley 64 is driven to execute a restricted pivotal movement by a motor 65 and a connecting member 66. This restricted pivotal movement of the pulley 64 leads to a corresponding movement of the deflection pulley 63 and via the belt 62 to a corresponding pivotal movement of the pulley 60, and thus of the pivot flap, so that the latter can be changed over from the position A to the position B and vice versa. The motor 65 can in this case either be rigidly secured to the bearing shield 14, or, as known in the prior art, mounted by way of a resilient mounting. A resilient mounting of this kind is laid out such that the forces which are necessary to adjust a pivot flap between the positions A and B are not sufficient to cause a substantial extension or compression of the resilient spring system but permit a deviation movement of the pivotal flap as a result of a blow.

Figure 7:
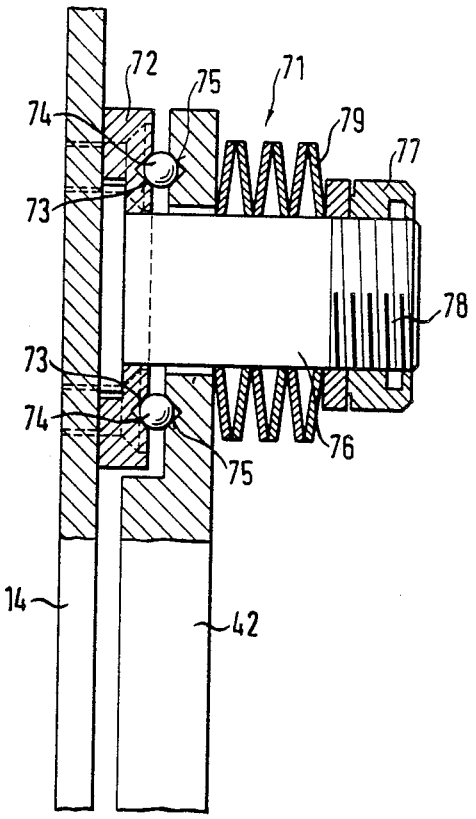
FIG. 7 is a schematic view of an alternative suspension for the links of the embodiment of FIG. 2.

In the embodiment of FIG. 7, the link 42 is pivotally connected to the associated shield or housing member 14 via a ball clutch or coupling 71 as an alternative to the arrangement shown in FIG. 2A. The ball clutch comprises a ring 72 which is secured to the bearing shield and which has, at its end face adjacent the link 42 recesses 73, for example in the form of bores which accommodate balls 74. At the side remote from the ring 72 the balls fit into corresponding recesses 75 in the head of the link 42. A boss 76 projects through the ring 72 and also through the head of the link and carries a compression spring 79, here in the form of plate springs, which press the link 42 against the ring 72. The spring force is moreover born at an abutment 77 which is adjustably secured to the spigot 76 via a thread 78. On reaching a predetermined torque the spring is compressed and the clutch slips. After removal of the article which led to the blow which caused this slipping of the clutch, the link can be pressed back into the initial position.

The link 42 must be positioned (suspended) in all embodiments such that the pivot flap suspended on it cannot be drawn into the opening roll(s) 11 and 12.

While the certain embodiments of the invention have been illustrated and described in detail, it is to be understood that the scope of the invention is to be ascertained from the claims which follow.

What is claimed is:

1. Apparatus for opening bales of textile fibers comprising at least one roll for opening said fiber bales rotatably journalled within a housing containing a conveyor shaft whereby suction can be applied to said conveyor shaft, the housing being open at a side facing the fiber bales and having a reversible direction of rotation of the roll depending on a prevailing direction of relative travelling movement of the housing relative to the fiber bales; a deflection member arranged within the housing and extending in a longitudinal direction of the roll, said deflection member deflecting fiber flocks supplied on one side of the roll into the conveyor shaft, and at least largely preventing leakage air coming from another side of the roll, the deflection member being able to deviate under the action of blows which act on it during bale opening, the deflection member being formed as a pivotal flap pivotally secured at side ends of the flap, in the region of a longitudinal edge of the flap adjacent the roll, via respective pivot axles to respective links for executing pivotal movements about an axis of rotation parallel to the longitudinal edge; the links being pivotally journalled about a pivot axis on the housing at respective ends of the links remote from the pivot axles; and at least one changeover means acting on at least one of the pivot axles being provided for changing over the direction of the pivotal flap in accordance with the direction of rotation.

2. Apparatus in accordance with claim 1, wherein the roll is pivotally journalled on plates at the end faces of the housing, the pivotal flap is located between the plates and the links are arranged outside of the plates.

3. Apparatus in accordance with claim 2, wherein the pivot axles extend through the respective plates and the plates have arc-like slots for the pivot axles with the arc-like slots being of circular curvature and having a center of curvature which coincides with the pivot axis of the links.

4. Apparatus in accordance with claim 1, wherein the means for changing over the pivotal flap comprises an extendible and retractable unit which is pivotally connected at its one end on a lever, the lever being fixedly mounted on the associated pivot axle, and the extendible and retractible unit being pivotally mounted to the link at a distance from the lever.

5. Apparatus in accordance with claim 4, wherein the extendible and retractable unit is pivotally connected at its end remote from the lever to a further lever mounted on the associated link in the region of its pivot axis at the housing.

6. Apparatus in accordance with claim 1, wherein resilient means is provided serving as a resetting spring acting on at least one of the links and biasing the latter into a predetermined position.

7. Apparatus in accordance with claim 6, wherein a boss passes through an opening in the pivotally journalled end of the biased link, the boss determining the pivot axis of the link and elastomeric spring elements being arranged in the opening between the link and the boss.

8. Apparatus in accordance with claim 1, wherein the means for changing over the pivotal flap comprises a belt drive having a belt which extends between a drive pulley mounted on one of the pivot axles and a deflecting pulley mounted on the link in the region of its pivot axis; and the deflecting pulley is drivable to execute a pivotal movement of the pivotal flap by a drive which is resiliently mounted on the housing.

9. Apparatus in accordance with claim 1, wherein switching cams are mounted on the link, or on parts movable therewith, and cooperate with a counter element during a deflection of the link caused by a blow and initiate a switching process that could be used for generating a warning signal and/or for stopping the operation.

10. Apparatus in accordance with claim 9, wherein the switching cams are provided at a head of the link.

11. Apparatus in accordance with claim 1, wherein the at least one opening roll comprises two opening rolls arranged alongside one another in a common housing; a partition wall is arranged between the two rolls with the partition wall extending upwardly and bounding, together with the housing, at least a part of the conveyor shaft; one pivotal flap being provided for each roll and the directions of the two pivotal flaps being capable of being in the same rotational sense corresponding to the prevailing direction of rotation of the rolls.

12. Apparatus in accordance with claim 9, wherein in one deflection position the longitudinal edge of a first one of the pivotal flaps remote from the associated roll contacts the partition wall and the corresponding edge of a second one of the pivotal flaps contacts a wall of the conveyor shaft formed by the housing; and in another deflection position the longitudinal edge of the first pivotal flap remote from the associated roll contacts a wall of the conveyor shaft formed by the housing whereas the corresponding edge of the second pivotal flap contacts the partition wall.

13. Apparatus in accordance with claim 1, wherein the links are secured to plates of the housing via respective slipping clutches capable of slipping.

14. Textile fiber bale opening apparatus comprising a housing movable across a fiber bale, an opening roll rotatably mounted in said housing and having surface elements for contacting fibers at the top surface of the bale to remove fiber blocks from the bale, link means connected to said housing for at least limited movement about an axis generally parallel to and above said opening roll, a deflection member pivotally mounted on said link means at a location close to said opening roll and spaced from said axis, said deflection member being pivotable on said link means between a first position relative to said housing such that said deflection member substantially blocks off passage of air around one side of said opening roll and a second position relative to said housing such that said deflection member substantially blocks off the passage of air around the opposite side of said opening roll, means for switching said deflection member between said first and second positions, and means yieldingly biasing said link means toward a normal angular position about said axis but permitting said link means to swing about said axis under the influence of blows acting on said deflection member during the removal of material from said bale by said opening roll.

15. A deflection member for a bale opening machine for opening bales of textile fibers including at least one opening roll which is rotatably journalled within a housing forming a conveyor shaft to which suction is applied, with the housing being open at a side facing the fiber bales and with a direction of rotation of the roll being reversible depending on a prevailing direction of relative travelling movement of the housing relative to the fiber bales, the deflection member being mountable within the housing so as to extend in a longitudinal direction of the roll for purposes of deflecting fiber flocks supplied on one side of the conveyor shaft, and at least largely preventing leakage air coming from another side of the roll, the deflection member being able to deviate under the action of blows as a result of bale opening, the deflecting member being formed as a pivotal flap and including pivot means for pivoting the pivotal flap about an axis adjacent a longitudinally extending edge of the pivotal flap which faces the opening roll when the deflection member is mounted in the bale opening machine.

16. The deflection member of claim 15, wherein the pivot means includes a pair of axles extending outwardly from opposite longitudinal ends of the pivotal flap.

17. The deflection member of claim 16, wherein the pivot means includes a first link and a second link, each rotatably supporting a respective one of the axles at one end thereof and includes means for pivotally mounting a second end thereof to the housing of the bale opening machine.

18. The deflection member of claim 17, wherein the means for pivotally mounting the second end of each respective one of the links to the housing comprises spring means for biasing the respective link such that the axis is in a desired position.

19. The deflection member of claim 17, further comprising changeover means for switching the pivotal flap to one of two positions when the deflection member is mounted in a bale opening machine, the changeover means being capable of rotating the pivotal flap in a first direction clockwise about the pivot axles to a first position and rotating the pivotal flap in a second direction counterclockwise about the pivot axles to a second position.

20. The deflection member of claim 17, wherein the changeover means includes a lever fixedly attached to one of the pivot axles for rotation therewith and an extendible and retractible unit pivotally connected at one end thereof to the lever and including means at another end thereof for pivotally connecting the extendible and retractible unit to the housing when the deflection member is mounted in the bale opening machine.

* * * * *